United States Patent [19]

Suttles

[11] Patent Number: 4,658,983

[45] Date of Patent: Apr. 21, 1987

[54] CUP DISPENSER

[75] Inventor: J. Marshall Suttles, Elberton, Ga.

[73] Assignee: Royston Corporation, Royston, Ga.

[21] Appl. No.: 738,344

[22] Filed: May 28, 1985

[51] Int. Cl.[4] ..... A47F 1/04

[52] U.S. Cl. ..... 221/44; 221/59; 221/304

[58] Field of Search ..... 221/44, 56, 59, 63, 221/241, 304, 307-310; 312/43

[56] References Cited

U.S. PATENT DOCUMENTS

| | | | |
|---|---|---|---|
| 2,315,827 | 4/1943 | Tansley | 312/43 |
| 2,373,217 | 4/1945 | Allen | 312/43 |
| 2,468,497 | 4/1949 | Johnson et al. | 312/43 |
| 2,606,087 | 8/1952 | Tansley | 312/43 |
| 2,780,388 | 2/1957 | Stephenson | 221/44 |
| 3,163,323 | 12/1964 | Behrens et al. | 221/4 |
| 3,203,587 | 8/1965 | Mount et al. | 221/63 |
| 3,581,934 | 6/1971 | Sciascia | 221/304 |
| 3,790,023 | 2/1974 | Filipowicz | 221/304 |
| 4,126,248 | 11/1978 | House | 221/241 |
| 4,234,101 | 11/1980 | Pastore | 221/241 |

*Primary Examiner*—F. J. Bartuska

*Attorney, Agent, or Firm*—Howson and Howson

[57] ABSTRACT

In this tubular cup dispenser, resilient cup-engaging fingers are secured to the inner wall of a tubular housing and extend both forwardly toward a front opening and radially inwardly. At the foremost end of each finger is a radially outwardly extending leg. Each leg has a forwardly extending foot which is guided by a radially extending slot in a ring attached to the tubular housing and surrounding the front opening. The inner face of the ring and the legs have interengaging teeth which, when engaged, prevent radial movement of the cup-engaging fingers. Disengagement of the teeth and adjustment of the fingers is accomplished by manipulation of the forwardly extending feet.

9 Claims, 3 Drawing Figures

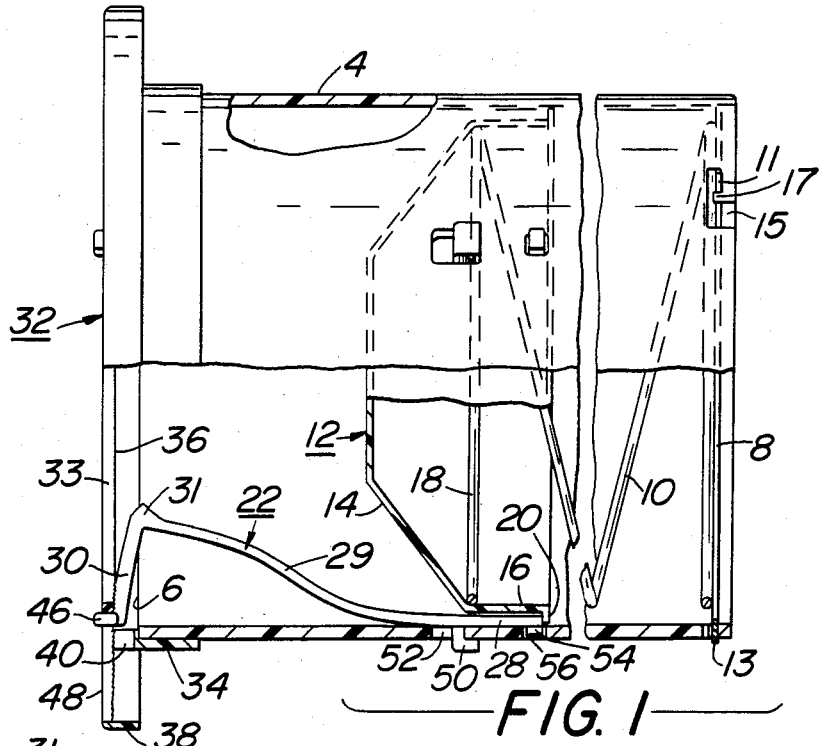
FIG. 1
FIG. 3
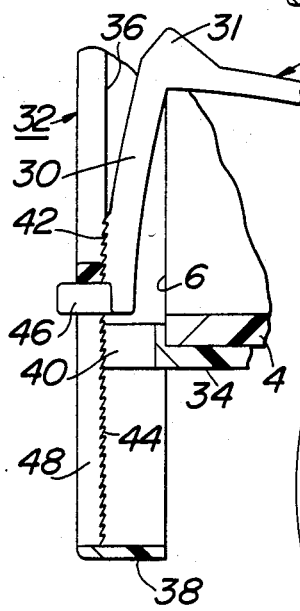
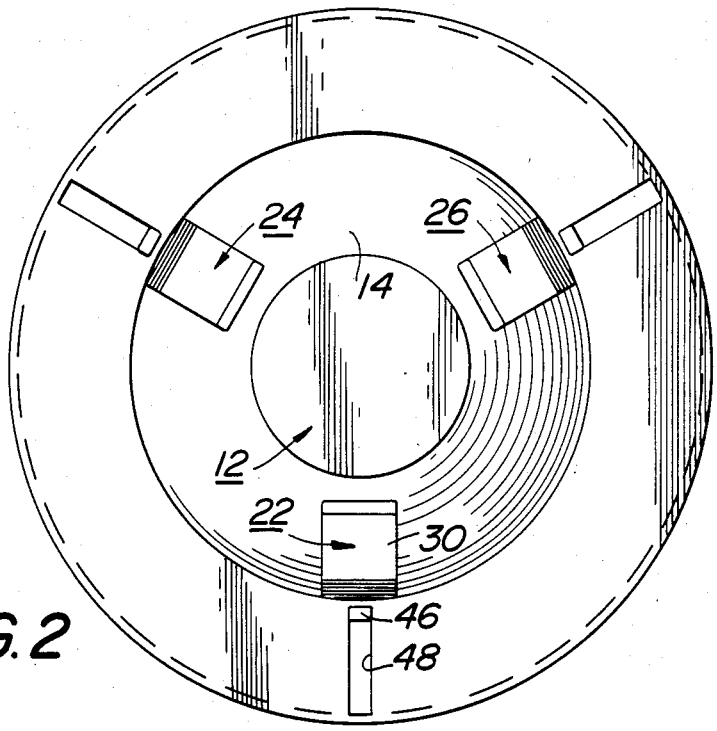
FIG. 2

CUP DISPENSER

BRIEF SUMMARY OF THE INVENTION

This invention relates to cup dispensers, and more specifically to a dispenser which stores a stack of plastic or paper cups and allows cups to be removed from the stack one-by-one. The invention concerns an adjusting mechanism which allows the dispenser to accommodate cups of different sizes so that a particular cup dispenser can be charged with a stack of small cups or with a stack of large cups, or with a stack of intermediate sized cups. The versatility of an adjustable dispenser is particularly desirable because soft drink companies and stores frequently hold promotions of soft drinks of a particular size. These promotions create the need for larger numbers of cups of the promotional size, and this need can be accommodated by an appropriate adjustment of the available dispensers. Adjustability also allows standardization of dispensers, which results in inventory reduction both for the manufacturer and for the manufacturer's customers.

Various adjustable cup dispensers have been proposed. They utilize screw adjusters, replaceable rings, rotatable rings, and various other forms of adjusting devices. In general, these devices are complicated, expensive, or difficult to adjust. One of the most significant problems is the difficulty in gaining access to the adjusting devices in panel-mounted cup dispensers.

The principal object of this invention is to realize all the benefits of adjustability in a cup dispenser which also has the advantages of inexpensiveness, ease of manufacture, ease of adjustability, simplicity of installation, ease of reloading, and ability to accommodate a wide range of cup sizes, or any combination of the above advantages. A further object of the invention is to realize the benefits of adjustability in a panel-mounted cup dispenser which is easily adjusted without the requirement for removal of the dispenser from its cabinet or enclosure.

These objects of the invention are realized through the use of a set of specially constructed, resilient cup-engaging fingers and a special ring which surrounds the opening of the cup dispenser and has radial slots through which project adjusting feet connected to the cup-engaging fingers. A set of teeth on a leg of each finger engages a set of teeth on the inside face of the ring to hold the finger in a fixed position. Disengagement of the teeth and adjustment of the fingers is achieved by pushing on the feet, and then adjusting them radially in the direction of their slots.

Further objects, advantages and details of the invention will be apparent from the following detailed description when read in conjunction with the drawings.

BRIEF DESCRIPTION OF THE DRAWINGS

FIG. 1 is a fragmentary, side elevational view, partly in longitudinal section, of a cup dispenser in accordance with the invention;

FIG. 2 is a front elevation of the cup dispenser, as viewed from the left-hand side of FIG. 1; and FIG. 3 is a fragmentary longitudinal section showing details of the interengaging teeth.

DETAILED DESCRIPTION

FIG. 1 shows an elongated, cylindrical tube 4, preferably of synthetic resin material. This tube can be mounted in any of a variety of ways. Typically, however, it is mounted behind a panel so that its end opening 6 is flush with the face of the panel. The tube can be supported by various brackets, or, alternatively, by the panel itself, through a ring secured both to the panel and to the front end of the tube.

The tube has a metal back closure 8, against which a coil spring 10 bears. The back closure 8 is a metal disc with three radially projecting tabs, two of which are shown at 11 and 13. Tab 11 is held in an L-shaped slot 15 formed in the rear end of the tube, and the other tabs are similarly held in L-shaped slots. The back closure is installed by aligning its tabs with the entrances to the L-shaped slots, pushing the back closure in the forward direction against the spring, and then rotating it clockwise to lock it in place. The pressure of spring 10 holds the back closure in place, and projection 17 along with similar projections in the other L-shaped slot prevent counterclockwise rotation of closure 8. The tube and closure 8, together, constitute a tubular housing.

A pusher 12 is longitudinally slidable within the tube. The pusher comprises a frusto-conical section 14 adapted to engage the open end of the last cup in a stack of cups. The diameter of the small-diameter end of section 14 is smaller than the smallest cup which the dispenser is designed to handle, and the diameter of the large-diameter end of section 14 is larger than the opening of the largest cup which the dispenser is designed to handle. A cylindrical section 16 of the pusher extends rearwardly from the large diameter end of frusto-conical section 14. End 18 of coil spring 10 is located within section 16, and bears against section 14 so that spring 10, which is in compression, urges the pusher 12 toward opening 6. A flange 20 is provided on the right-hand end of cylindrical section 16 for engagement with the ends of the adjustable fingers, which serve as stop means, limiting the forward movement of the pusher.

Three substantially identical resilient fingers are provided. One such finger is seen in FIG. 1 at 22, and the other two fingers, 24 and 26, are seen in FIG. 2. These fingers are disposed 120 degrees apart inside tube 4, near its front opening 6. The number of such fingers is preferably at least three, to insure that the cup stack is supported symmetrically with respect to the tube. However, larger numbers of fingers can be used if desired.

End section 28 of finger 22 extends along the inner wall of tube 4 through a short distance. The area of contact between end section 28 and the wall of the tube is located near, but spaced from the opening. A flexible, resilient curved section 29 gradually slopes inwardly and toward opening 6, where it is integrally connected to a leg 30 which extends generally radially outwardly. A cup rim engaging lip 31 is located at the junction of curved section 29 and leg 30. A ring 32 is provided at the front end of tube 4. The ring has an opening 33, which is coaxial with the tube and with front opening 6. A collar 34, which is preferably, though not necessarily, an integral molded part of ring 32, fits over the outside of tube 4. The ring and collar are secured to the tube by an adhesive cement, or by other suitable means. Inner face 36 of ring 32 is spaced from the end of tube 4 to provide a clearance for outward radial movement of leg 30. Ring 34 has an opening 40 to provide clearance for leg 30.

As shown in FIG. 3, leg 30 has a set of teeth 42, and inner face 36 of ring 32 has a set of teeth 44. Teeth 42 and 44 engage each other, and prevent radial movement of leg 30, thereby holding cup rim engaging lip 31 in a fixed position relative to the housing.

Leg 30 terminates in a foot 46, which is narrower than the width of leg 30 (as shown in FIG. 2). Foot 46 extends in the forward direction, generally parallel to the axis of tube 4, through a radial slot 48 formed in the ring. The inner face 36 of the ring has teeth 44 on both sides of slot 48. Preferably, although not necessarily, the teeth 42 and 44 are formed in a ratchet configuration which allows radial inward movement of leg 30 upon application of a slight radial inward force to foot 46, but which prevents radial outward movement of leg 30 unless the teeth are positively disengaged by the application of an axial, rearwardly directed force to foot 46. Thus, adjustment of cup rim engaging lip 31 is achieved by manipulation of foot 46. Normally, the resiliency of section 29 of the leg holds teeth 42 in engagement with teeth 44. To adjust finger 22 outwardly to accommodate larger cups, foot 46 is pushed rearwardly, and then downwardly, after which it is released to reengage the teeth and establish a proper position for lip 31. When the finger is at a position outward with respect to its innermost position, inward adjustment is achieved simply by the application of a slight upward pressure on foot 46. Fingers 24 and 26 are similarly adjusted.

The fingers can be secured to the inside of the tubular housing by any suitable means. However, preferably the attachment is as shown in FIG. 1, in which a lance 50, integrally formed on end section 28 of finger 22, extends through opening 52, and then rearwardly against the outside wall of tube 4, thereby holding the finger in place by a hooking action. Because section 28 is resilient, projection 54 at the end of section 28 snaps into an opening 56, thereby insuring that the finger is securely held in place. With the fingers thus held in place on the inner wall of tube 4, the ends of the fingers serve as abutments for flange 20, and thereby limit the forward movement of pusher 12. Removal of the fingers for cleaning purposes is accomplished by pushing projection 54 (FIG. 1) inwardly to bend the resilient end section 28 and thereby disengage projection 54 from opening 56, and then sliding the end section of the finger forwardly to disengage lance 50 from slot 52. To make this possible, opening 56 should be a through opening.

One of the most important features of the invention is the design of ring 32 so that the distance between its inner and outer diameters accommodates radial slots, such as slot 48, which are long enough to permit adjustment of the fingers through the desired range.

The cup dispenser of the invention is inexpensive to manufacture, being made primarily of easily molded plastic parts. Assembly and disassembly are relatively simple, and therefore manufacture and cleaning are easy to accomplish. Adjustment is a simple matter of manipulation of feet corresponding to foot 46, extending forwardly through the radial slots in the face ring. These feet are immediately accessible, and therefore adjustment can be accomplished quickly and without requiring removal of the housing from the cabinet or other enclosure containing it. The dispenser, by virtue of the adjustment of the fingers, is capable of handling a wide range of cup sizes. It can be supplied to the user in assembled condition, and installed in a very simple manner on any convenient form of mounting bracket, or by securing the face ring to a panel. Reloading of the dispenser is easily accomplished by temporarily adjusting the fingers radially outwardly, inserting a stack of cups, and then adjusting the fingers inwardly so that their lips engage the rim of the foremost cup. This engagement can easily be seen through opening 33 in the ring.

Various modifications can be made to the invention. For example, to reduce the likelihood of unauthorized or inadvertent adjustment of the cup-engaging fingers, the feet can be shortened, or eliminated altogether, so that there is nothing which projects forward of the slots. The leg of each finger (corresponding to leg 30) can be provided with a recess to receive a special adjusting tool. Adjustment is then accomplished by inserting the adjusting tool through the radial slot in the face ring, and using the tool to disengage the ratchet teeth and move the leg radially to the desired position. Alternatively, the adjusting feet can be hidden by a snap-on, snap-off cover ring which is used to conceal the adjusters. As another alternative, the likelihood of unauthorized adjustment can be reduced by providing the ring and the adjusters in the same color, thereby making the adjusters less visible. Dummy adjusters can be molded into the front face of the ring, thereby making it more difficult to find the true adjusters. Numerous other modifications can be made to the cup dispenser herein disclosed without departing from the scope of the invention, which is defined in the following claims.

I claim:

1. A cup dispenser comprising:

means comprising an axially elongated tubular housing, for receiving a nested stack of cups to be dispensed, said housing having an opening at one of its ends;

means within the housing for pushing a stack of cups therein toward the opening;

a plurality of cup-engaging fingers, each comprising a flexible resilient element having one end connected to the tubular housing means at a location spaced axially from said opening, said flexible element being located within the housing and extending toward said opening, and the other end of said flexible element having a leg extending radially outwardly therefrom;

the tubular housing having clearance for each leg, allowing the leg to move radially inwardly, and radially outwardly beyond the wall of the tubular housing; and retaining means, immovably connected to the tubular housing and extending radially outwardly therefrom, for retaining the legs in adjustable fixed relationship to the tubular housing;

the retaining means and each leg having interengaging means, the interengaging means of the retaining means being immovably connected to the tubular housing, and the interengaging means of the legs being movable toward the interengaging means of the retaining means in directions transverse to the radial directions of movement of the legs and also being movable away from the interengaging means of the retaining means, the resilience of the flexible resilient elements urging the legs against the retaining means in said transverse directions, and the interengaging means of the retaining means and legs preventing radial movement of the legs when the legs are positioned against the retaining means but permitting radial adjusting movement of the legs when the legs are pushed away from the retaining means against the urging action of the flexible resilient elements.

2. A cup dispenser according to claim 1 in which, at least when the legs are positioned against the retaining means in their radial innermost condition, each of the flexible elements extends from its said one end connected to the tubular housing toward the opening of the housing with a gradual slope toward the central axis of the tubular housing.

3. A cup dispenser according to claim 1 in which the interengaging means comprises interengaging teeth on the retaining means and on each leg.

4. A cup dispenser according to claim 1 in which each cup-engaging finger has a cup rim engaging projection at the location of said other end of its flexible element.

5. A cup dispenser according to claim 1 in which each of said fingers has an L-shaped lance and an auxiliary projection located near its end connected to the tubular housing, in which the tubular housing has a slot and a hole for each finger, and in which each finger is connected to the tubular housing by the engagement of its L-shaped lance with a corresponding slot on the housing and by the engagement of its auxiliary projection with a corresponding hole in the housing, the resilience of the finger maintaining the auxiliary projection in its hole, and the engagement of the auxiliary projection in its hole preventing disengagement of the L-shaped lance from its slot.

6. A cup dispenser according to claim 1 in which the ends of the fingers which are connected to the tubular housing means are all located in a common plane perpendicular to the central axis of the tubular housing means and extend inwardly at least a short distance from the interior wall of the housing means, and in which the pushing means includes a cup-engaging means movable toward the opening of the housing and having a rim engageable with the ends of the fingers in its movement toward the opening of the housing, whereby the ends of the fingers limit the movement of the cup-engaging means toward said opening.

7. A cup dispenser according to claim 1 in which the fingers are connected to the tubular housing by snap-acting fastening means and in which the ends of the fingers which are connected to the tubular housing means are all located in a common plane perpendicular to the central axis of the tubular housing means and extend inwardly at least a short distance from the interior wall of the housing means, and in which the pushing means includes a cup-engaging means movable toward the opening of the housing and having a rim engageable with the ends of the fingers in its movement toward the opening of the housing, whereby the ends of the fingers limit the movement of the cup-engaging means toward said opening.

8. A cup dispenser comprising:

means comprising an elongated tubular housing, for receiving a nested stack of cups to be dispensed, said housing having an opening at one of its ends;

means within the housing for pushing a stack of cups therein toward the opening;

a ring fixed to the housing and surrounding the opening of the housing, the ring having a central opening in register with said opening of the housing and also having a front and back face and plurality of slots providing openings extending from the front face to the back face of the ring, the slots extending radially on the faces of the ring and being located at circumferentially spaced intervals;

a plurality of cup-engaging fingers, there being one cup-engaging finger corresponding to each of said slots, each cup-engaging finger comprising a flexible resilient element having one end connected to the tubular housing means at a location spaced axially from the ring, said flexible element being located within the housing and extending toward the opening of the ring, the other end of said flexible element having a leg extending radially outwardly therefrom;

the structure comprising the tubular housing and the ring fixed thereto having a radial opening for each leg, allowing the leg to move inwardly and outwardly through its corresponding radial opening;

the resilience of the flexible resilient elements urging the legs against the back face of the ring, the ring and each leg having interengaging means for preventing radial movement of the legs when the legs are positioned against the back face of the ring, and the legs being positioned in register with the slots, and each leg having a foot extending at least partway into one of the slots, whereby the interengaging means can be disengaged by pushing the feet.

9. A cup dispenser comprising:

means comprising an elongated tubular housing, for receiving a nested stack of cups to be dispensed, said housing having an opening at one of its ends;

means within the housing for pushing a stack of cups therein toward the opening;

a plurality of cup-engaging fingers, each comprising a flexible resilient element having one end connected to the tubular housing means at a location spaced axially from said opening, said flexible element being located within the housing and extending toward said opening, and the other end of said flexible element having a leg extending radially outwardly therefrom;

the tubular housing having clearance for each leg, allowing the leg to move radially inwardly, and radially outwardly beyond the wall of the tubular housing; and retaining means, connected to the tubular housing and extending radially outwardly therefrom, for retaining the legs in adjustable fixed relationship to the tubular housing;

the resilience of the flexible resilient elements urging the legs against the retaining means, and the retaining means and each leg having interengaging means for preventing radial movement of the legs when the legs are positioned against the retaining means but permitting radial adjusting movement of the legs when the legs are pushed away from the retaining means against the urging action of the flexible resilient elements; and each of said fingers having an L-shaped lance and an auxiliary projection located near its end connected to the tubular housing, the tubular housing having a slot and a hole for each finger, each finger being connected to the tubular housing by the engagement of its L-shaped lance with a corresponding slot on the housing and by the engagement of its auxiliary projection with a corresponding hole in the housing, the resilience of the finger maintaining the auxiliary projection in its hole, and the engagement of the auxiliary projection in its hole preventing disengagement of the L-shaped lance from its slot.

* * * * *